US009824785B1

(12) United States Patent
Hübler

(10) Patent No.: US 9,824,785 B1
(45) Date of Patent: Nov. 21, 2017

(54) ENERGY CONVERSION WITH STACKS OF NANOCAPACITORS

(71) Applicant: Board of Trustees of the University of Illinois, Urbana, IL (US)

(72) Inventor: Alfred W. Hübler, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 821 days.

(21) Appl. No.: 14/223,180

(22) Filed: Mar. 24, 2014

Related U.S. Application Data

(60) Provisional application No. 61/810,880, filed on Apr. 11, 2013.

(51) Int. Cl.
*G21H 1/00* (2006.01)
*H05H 5/04* (2006.01)

(52) U.S. Cl.
CPC ..... *G21H 1/00* (2013.01); *H05H 5/04* (2013.01)

(58) Field of Classification Search
CPC combination set(s) only.
See application file for complete search history.

(56) References Cited

U.S. PATENT DOCUMENTS 2,548,225 A * 4/1951 Linder ..... G21H 1/04 310/304
2,765,414 A * 10/1956 Gendler ..... G21H 1/00 122/275
2,858,459 A * 10/1958 Schwarz ..... G21H 1/04 250/493.1
2,876,368 A * 3/1959 Thomas ..... G21H 1/00 310/305
3,591,860 A * 7/1971 Sampson ..... G21H 1/04 136/202
5,861,701 A * 1/1999 Young ..... G21H 1/04 310/304
6,238,812 B1 * 5/2001 Brown ..... G21H 1/00 310/302
8,699,206 B1 4/2014 Hubler et al. ..... 361/326
9,305,674 B1 * 4/2016 Wertsching ..... H01L 31/0406
2004/0163942 A1 * 8/2004 Yoshida ..... G21H 1/00 204/157.15
2006/0120020 A1 * 6/2006 Dowgiallo, Jr. ..... H01G 4/12 361/313

(Continued)

FOREIGN PATENT DOCUMENTS

WO WO 2012/042329 A1 4/2012 ..... G21H 1/00

OTHER PUBLICATIONS

Popa-Simil, "Advanced Space Nuclear Reactors from Fiction to Reality," *Phys. Procedia*, vol. 20, pp. 270-292 (2011).

*Primary Examiner* — Sean P Burke
(74) *Attorney, Agent, or Firm* — Sunstein Kann Murphy & Timbers LLP

(57) ABSTRACT

Methods and apparatus for converting kinetic energy of an energetic particle into electrical energy and for accelerating charged particles. A stack of substantially parallel conductors separated by gaps is disposed such that the conductors are substantially parallel to the surface of a cathode, with the conductors mutually electrically uncoupled. An anode is disposed at an end of the stack of conductors distal to the cathode, and a power management system applies a bias voltage between the cathode and the anode and collects charge deposited at the anode in the form of current in an external electrical circuit.

18 Claims, 1 Drawing Sheet

(56) References Cited

U.S. PATENT DOCUMENTS

| | | | | |
|---|---|---|---|---|
| 2010/0061503 | A1 | 3/2010 | Popa-Simil | 376/409 |
| 2012/0080978 | A1 | 4/2012 | Makhlouf et al. | 310/305 |
| 2013/0121449 | A1* | 5/2013 | Popa-Simil | G21B 3/002 376/147 |

* cited by examiner

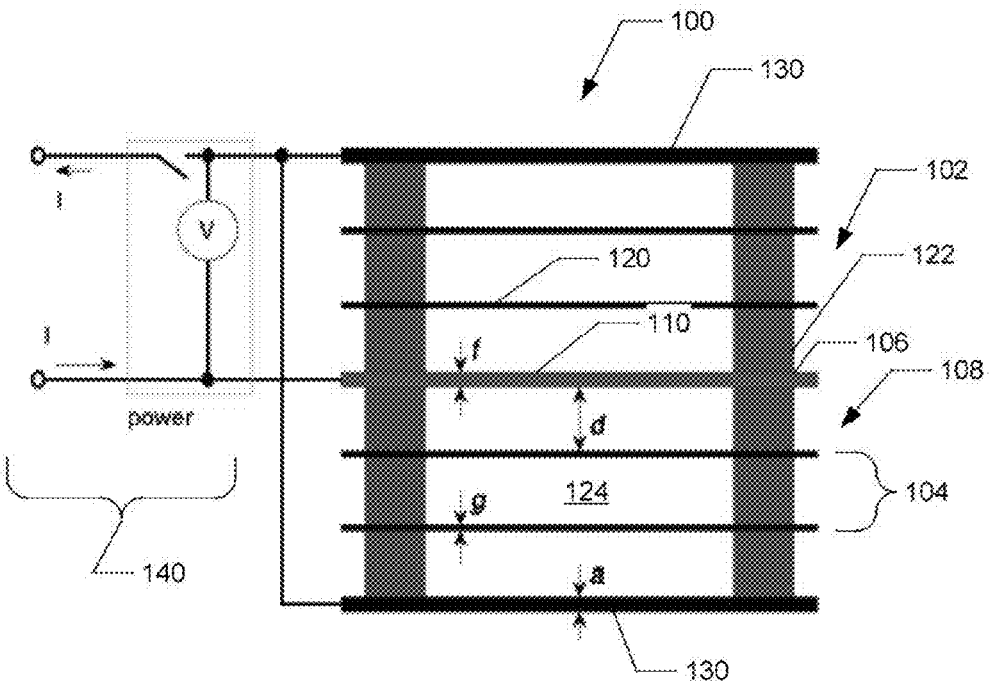
100
130
102
122
120
110
106
108
f
d
124
104
g
a
130
140
V
I
I
power

ENERGY CONVERSION WITH STACKS OF NANOCAPACITORS

The present Application claims the priority of U.S. Provisional Patent Application Ser. No. 61/810,880, filed Apr. 11, 2013, which is incorporated herein by reference.

This invention was made with government support under Contract No. 1-485927-244014-191100, awarded by the U.S. Air Force. The Government has certain rights in the invention.

The present application contains subject matter related to that of U.S. patent application Ser. No. 12/908,107 (hereinafter "Hübler '107"), filed Oct. 20, 2010, and now issued as U.S. Pat. No. 8,699,206, and to that of U.S. patent application Ser. No. 14/186,118 filed Feb. 21, 2014, and now issued as U.S. Pat. No. 9,218,906. All of the foregoing applications are incorporated herein by reference.

FIELD OF INVENTION

The present invention relates to devices and methods for conversion between the kinetic energy of charged particles and electrical energy, either for stopping charged particles and accumulating electrical charge or, conversely, for nanoscale acceleration of charged particles.

BACKGROUND ART

The use of a repeated sequence of capacitor-like structures for direct power conversion of the kinetic energy of charge particles, such as nuclear fission products, has been suggested in a variety of guises, including, for example, Published Patent Application WO2012042329, filed Sep. 20, 2011, entitled Radioactive Isotope Electrostatic Generator, L. Popa-Simil, *Pseudo-Capacitor Structure for Direct Nuclear Energy Conversion*, MRS Proceedings, 1100, 1100-JJ04-14 doi:10.1557/PROC-1100-JJ04-14 (2008), and US Published Patent Application 2010/0061503, filed Mar. 31, 2009, entitled "Pseudo-Capacitor Structure for Direct Nuclear Energy Conversion," all of which are incorporated herein by reference. In all of the foregoing structures, alternating electrodes are electrically coupled such that electrical charge may flow from at least some of the electrodes to other electrodes within a stack of electrodes.

Limitations of conventional nuclear power conversion techniques, as those intermediated by heat engines, include poor efficiency, typically in the range of about 35%, which is much less than the Carnot efficiency for the entire process, because the temperature of steam used in a steam engine to power electrical generators is substantially less than the initial kinetic energy of products of the fission process at the core of a nuclear reactor.

Moreover, the limitation of other direct power conversion devices include their large size, due to the maximum electric fields supported by respective structures, and the difficulties presented by lack of scalability.

SUMMARY OF EMBODIMENTS OF THE INVENTION

The present invention relates to nanocapacitors that may have dielectric spacing comprising vacuum, low-density gas, or solid dielectric.

As used herein and in any appended further description or claims, the term "nano-capacitor" is used interchangeably with the term "nanocapacitor." The meaning of the term is that of a capacitor characterized by at least one dimension in the range between 0.1 nanometers and 1000 nanometers.

In accordance with embodiments of the present invention, an energy converter is provided for converting kinetic energy of an energetic particle such as a fission product, for example, to electrical energy. The device has:

a. a cathode characterized by a surface;

b. a stack of conductors separated by gaps of between approximately 0.1 nm and approximately 1000 nm, the conductors disposed substantially parallel to the surface of the cathode to at least one side thereof, the conductors mutually electrically uncoupled;

c. an anode disposed at an end of the stack of conductors distal to the cathode; and d. a power management system for collecting charge deposited at the anode in the form of current in an external electrical circuit.

In accordance with various embodiments of the present invention, the cathode may be a fuel layer for producing secondary charged particles upon incidence of an energetic particle. The cathode may be planar, cylindrical, or spherical. There may be two anodes disposed at respective ends of stacks of conductors in any direction with respect to the surface of the cathode.

In various embodiments of the invention, the conductors may be formed from graphene, including grapheme monolayers. The anodes may also be formed of graphene, more particularly graphene multilayers. Alternatively, the anodes may be formed of a moderator and a metal neutron reflector, wherein the moderator may optionally be water.

In accordance with other embodiments of the invention, the fuel layer may be a generator of alpha particles upon impingement by energetic particles. The fuel layer may be $^{241}$Americium or any other typical feedstock to a nuclear chain reaction or nuclear decay.

In further embodiments of the present invention, the stack of conductors may be separated by semiconductor or insulating spacers.

In yet further embodiments of the present invention, the energetic particle may be a product of nuclear fission.

In further embodiments still, a DC electrical bias may be sustained between the cathode and respective anodes.

In accordance with another aspect of the present invention, a method is provided for converting kinetic energy of a particle to electrical energy using an energy converter in accordance with any of the structures described above.

In accordance with a further aspect of the present invention, a method is provided for shielding a nuclear reactor using an energy converter in accordance with any of the structures described above.

In accordance with a further aspect of the present invention, a method is provided for shielding a nuclear reactor using an energy converter in accordance with any of the structures described above.

In accordance with yet further embodiments of the present invention, a method is provided for accelerating charged particles using the energy converter in accordance with any of the structures described above. More particularly, charged particles may be accelerated for treating materials including human tissue, or for generating x-rays and shaping beams of x-rays for various applications such as x-ray lithography.

In accordance with another embodiment of the present invention, an energy converter is provided for converting kinetic energy of an energetic particle such as a fission product, for example, to electrical energy. The device has:

an anode characterized by a surface;

a stack of conductors separated by gaps of between approximately 0.1 nm and approximately 1000 nm, the conductors disposed substantially parallel to the surface of the anode to at least one side thereof, the conductors mutually electrically uncoupled;

a cathode disposed at an end of the stack of conductors distal to the anode; and a power management system for collecting charge deposited at the cathode in the form of current in an external electrical circuit.

BRIEF DESCRIPTION OF THE DRAWING

The foregoing features of the invention will be more readily understood by reference to the following detailed description, taken with reference to the accompanying drawing, in which:

FIG. 1 schematically depicts a dual stack of nanocapacitors configured about a nuclear fuel element, in accordance with an embodiment of the present invention.

DESCRIPTION OF SPECIFIC EMBODIMENTS OF THE INVENTION

Definitions

As used herein and in any appended claims, the term "nano-capacitor" shall refer to a capacitor having an effective electrode spacing on the order of approximately 0.1-1000 nm, unless the context requires otherwise.

The term "effective electrode spacing" is the thickness of a dielectric separating two conductors multiplied by the dielectric constant of the separating medium.

The term "dielectric strength," as used to characterize a dielectric herein and in any appended claims, shall refer to the maximum electric field that may be applied across the dielectric before it breaks down and conducts electrical charge.

As use herein and in any appended claims, the term "particle" shall refer to a localized object characterized by a mass and by a dimension comparable in size, or smaller, than the inter-nuclear spacing in a solid.

In the context of the current description, a particle may be referred to as "energetic" if its kinetic energy exceeds 1 keV.

Nuclear "fuel," as the term is used herein and in any appended claims, refers to a material which emits energetic particles, either spontaneously, by nuclear decay, or secondarily when impinged upon by an incident energetic particle.

In accordance with embodiments of the present invention, the dielectric strength of nanocapacitors is used, in a serial stack, to support large potential differences and thus to either decelerate charged particles impinging with large initial kinetic energies or to accelerate charged particles to substantial energies. Hübler '107 teaches that nano-capacitors can have much higher dielectric strength than other capacitors, because dielectric strength increases with decreasing electrode spacing. In the discussion that follows, it is shown that the dielectric strength of such capacitors may exceed 1 GV/mm.

In one embodiment of the invention, high tensile strength graphene electrodes are employed, as further described herein.

Insofar as the volumetric energy density of energy stored in a capacitor is $U_d=\epsilon_0\epsilon E^2$, where $\epsilon_0$ is the vacuum permittivity, $\epsilon$ is the dielectric constant characterizing the dielectric, and E is the electric field in the dielectric, stored energy is optimized by maximizing E. For a parallel plate geometry, the electric field is the applied voltage V divided by the capacitor spacing d, so stored energy density scales as $(V/d)^2$, and correspondingly for other geometries.

Advantages of the present invention and its several improvements will be seen when the following detailed description is read in conjunction with the attached drawing.

Referring to FIG. 1, a novel energy converter, designated generally by numeral 100, is now described. A stack 102 of nanocapacitors 104 is disposed substantially parallel to the surface of a cathode 106 to at least one side thereof. In the embodiment of the present invention depicted schematically in FIG. 1, there are two stacks 102, 108 of nanocapacitors, each disposed on a side of cathode 106 opposite to the other, although, in accordance with other embodiments of the invention, stacks may be disposed in any direction with respect to the surface of the cathode.

In the embodiment shown, cathode 106 has a fuel layer 110 of thickness f that may constitute the entire thickness of cathode 106 or may be deposited on one or both of its upper and lower surfaces. The heat generated within the fuel layer scales with the square of the thickness of the fuel, thus it is advantageous to use thin sheets of fuel.

In preferred embodiments of the invention, successive conductors 120 are monolayers of graphene, although other electrically conducting materials may be used within the scope of the present invention. Conductors 120 are substantially parallel to each other, and to cathode 106, and it is to be understood that the planar geometry shown in FIG. 1 is presented by way of example only. Cathode 106, and similarly, conductors 120, may have any other geometry, such as cylindrical or spherical, for example, within the scope of the present invention. Conductors 120 are electrically insulated from each other and spaced apart by intervening dielectrics, which may be solids or may be a partial vacuum. Spacers 122 between conductors 120 may be insulators or dielectrics. The charge left on each conductor upon passage of a charged particle may be used as an electric power source, as in alpha-voltaic batteries.

Top and/or bottom electrode(s) serve as anode 130, again substantially parallel to other conductors 120 of the stack 102 or 108. In preferred embodiments of the invention, anodes 130 consist of graphene multilayers with about 10 layers of graphene. Anode 130 may also include a water moderator or metal neutron reflector to absorb charged nuclear reaction products and to moderate and reflect neutrons. Graphene multilayers are good thermal conductors and may be used advantageously to cool the energy converter.

Fuel layer 110 may be a $^{241}$Americium sheet. For heuristic purposes only, it is assumed here that the initial kinetic energy K of each reaction product is above 1 MeV (although the invention is not so limited) and that the reaction product has a positive electric charge. $^{241}$Americium produces 5.6 MeV alpha particles. For the energy conversion, it makes no difference whether the nucleus is fully or partially ionized or whether the energetic particle originates from fission or any other nuclear reaction. The average energy loss of the charged nuclear reaction products within the fuel is proportional to the thickness of the thin sheet, that is:

$$\Delta K_f = \frac{dE}{dx} \cdot \frac{f}{2},$$

where $$\frac{dE}{dx}$$

is the stopping power acting on the charged energetic particle within the fuel. For instance, for K=5.6 MeV alpha particles, the stopping power of Americium is $$\frac{dE}{dx} \approx 240 \text{ eV/nm}.$$

In a fuel layer of thickness f=1000 nm, the energy loss for alpha particles with a kinetic energy of K=5.6 MeV is $K_f$=120 keV, that is, the particles lose about 2% of their energy within the fuel. The heat created by a nuclear reaction product within a fuel sheet of area A is $$H_f = \Delta K_f \cdot f = \frac{dE}{dx} \cdot \frac{f^2}{2} \cdot A.$$

Because the heat $H_f$ created in the fuel scales with the square of the thickness of the fuel, it is advantageous to use thin sheets of fuel. The fuel sheet is sandwiched by two stacks 102, 108 of N sheets of graphene monolayers. The top and bottom sheets 130 (also referred to herein as layers, and as anodes) are preferably graphene multilayers of width a, or a more complex conducting layered structure. A power management system 140 maintains a constant potential difference between the fuel sheet and the outside layers. The top and bottom layers have three functions: (i) They are the anodes of the device; (ii) they stop and absorb the charged nuclear reaction products; and (iii) the may serve to connect the device to a cooling system.

Slightly doped silicon spacers or other radiation-hard semiconductor spacers 122 keep the graphene layers 120 apart and maintain a constant voltage difference ΔV between adjacent graphene monolayers. Gaps 124 between graphene layers 120 are evacuated or filled with a low-density, non-reactive gas. The resistance R of the spacers 122 is assumed to be large compared with the resistance of the battery load.

In one embodiment of the invention, the distance between the graphene layers is d=500 nm. The graphene layers form a stack 102 of nanocapacitors 104. The potential difference between the outside layers 130 and the fuel 110 is V=N·ΔV. Because the layers of graphene divide the space between the fuel 110 and outside electrodes 130 into small compartments, avalanching is suppressed and the electric field in the vacuum gaps and the silicon spacers can be as large as $$E = \frac{V}{N \cdot d} = 1 \text{ V/nm}.$$

The charged nuclei are decelerated in the electric field between the graphene sheets and finally thermalized and neutralized in the top and bottom graphene sheets 130. When the nuclei pass through the capacitors, collisions with the carbon atoms in the graphene sheets convert some of their kinetic energy to heat, $$\Delta K_g = \frac{dE}{dx} \cdot g,$$

where $$\frac{dE}{dx}$$

is the stopping power or graphene (or other constituent of conductor 120) and g is the thickness of conductor 120, typically g=0.34 nm for single sheets of graphene.

The stopping power $$\frac{dE}{dx}$$

is, of course, a function of the kinetic energy of the energetic particle. For example, the stopping power of graphite for high-energy alpha particles (5.6 MeV) and low-energy alpha particles (20 keV) is $$\frac{dE}{dx} = 150 \text{ eV/nm},$$

whereas the stopping power of graphite for medium-energy alpha particles (600 keV) is about is $$\frac{dE}{dx} = 440 \text{ eV/nm}.$$

Use of a medium value of is $$\frac{dE}{dx} = 300 \text{ eV/nm}$$

to estimate me energy loss in graphene monolayers yields an estimate of $\Delta K_g \approx 100$ eV at 5.6 MeV. The amount of electrostatic energy converted to heat in each capacitor is $\Delta K_e = d \cdot E \cdot Z = 1$ keV for alpha particles. The fraction of energy that is stored as electrostatic energy is $$\in = \frac{\Delta K_e}{\Delta K_e + \Delta K_g} = \frac{d \cdot E \cdot Z}{d \cdot E \cdot Z + \frac{dE}{dx} \cdot g} > 90\%$$

for alpha particles. A charged nuclear reaction product loses its kinetic energy after passing through N nanocapacitors, where $$N = \frac{K}{\Delta K_e + \Delta K_g}.$$

For K=5.6 MeV alpha particles, the value of N≈5000/ This suggests a design with a stack N=5000 nanocapacitors on each side of the fuel layer. The potential difference between the fuel sheet 110 and the top layer 130 is V=N·E·d. Thus, 5.6 MeV alpha particles create a 2.5 MV DC potential difference. The magnitude of current created by the ions is $$I = S \cdot e \cdot f \cdot A \cdot Z,$$

where A is the area of fuel layer 110 and S is the specific activity of the fuel, that is, the number of decays within a volume v and a time span Δt. For a 1–Ci $^{241}$Am source, the current is I=12 nA, and the electric power is P=30 mW.

It may be evident to persons of ordinary skill in the art that other designs may provide a larger value of ∈. For instance, if gap size d is increased without decreasing the dielectric strength E significantly, then the number of graphene sheets N can be reduced and the conversion efficiency of ∈ increases. A cylindrical geometry where the anode is a carbon nanotube could sustain much larger electric fields, because anode work functions are much larger than cathode work functions.

A device with a $^{242m}$Am (metastable) fuel source could have a much larger specific activity and, therefore, a much larger power rating. Because of the high neutron cross section $^{242m}$Am and low neutron self-absorption in thin foils, a chain reaction seems possible in micrometer-thick Americium foils, and other fissable materials. The critical mass for $^{242m}$Am is speculated to be only 20 g. The graphene multilayer electrodes could function as radiation-hard neutron moderators and reflectors. The kinetic energy of the neutrons could be harvested with a two-step process. (1) First, a layer of paraffin or proton-rich plastic outside the top and bottom layers is used to transfer kinetic energy from neutrons to protons with a neutron recoil reaction. This transfer is efficient, because neutrons and protons have roughly the same mass. (2) Protons are decelerated in a second stack of nanocapacitors similar to the other charged nuclear reaction products.

The embodiments of the invention described herein are intended to be merely exemplary; variations and modifications will be apparent to those skilled in the art. In particular, it is to be understood that central source, heretofore referenced as cathode 106, or conducting layers adjacent thereto, may emit predominantly particles with a positive charge rather than a negative charge. In that case, the anode would be central to the structure, whereas the distal electrodes 130 would serve as cathodes. Reversal of the electric polarity of all elements relative to that hitherto described is considered to be an obvious variant of the described invention, and falls within the scope of the invention as presently claimed. All such variations and modifications are intended to be within the scope of the present invention as defined in any appended claims.

I claim:

1. An energy converter for converting kinetic energy of an energetic particle into electrical energy, the energy converter comprising:

a. a cathode characterized by a surface;

b. a first stack comprising a plurality of conductors separated by gaps of between approximately 0.1 nm and approximately 1000 nm, the conductors disposed substantially parallel to the surface of the cathode to at least one side thereof, the conductors mutually electrically uncoupled;

c. a first anode disposed at an end of the first stack of conductors distal to the cathode and electrically biased to a potential relative to the cathode exceeding the kinetic energy of the energetic particle; and d. a power management system for collecting charge deposited at the anode in the form of current in an external electrical circuit.

2. The energy converter as set forth in claim 1, wherein the cathode includes a fuel layer for producing secondary charged particles upon incidence of the energetic particle.

3. The energy converter of claim 1, wherein the cathode is planar.

4. The energy converter of claim 1, wherein the cathode is cylindrical.

5. The energy converter of claim 1, wherein the cathode is spherical.

6. The energy converter of claim 1, further comprising a second anode disposed at an end of a second stack of conductors distal to the cathode and in a direction distinct from any direction from the cathode to the first anode.

7. The energy converter of claim 1, wherein the conductors include graphene.

8. The energy converter of claim 1, wherein the conductors include a graphene monolayer.

9. The energy converter of claim 1, wherein the first anode includes graphene.

10. The energy converter of claim 9, wherein the first anode includes a plurality of layers of graphene.

11. The energy converter of claim 1, wherein the first anode further comprises a moderator and a metal neutron reflector.

12. The energy converter of claim 11, wherein the moderator includes water.

13. The energy converter of claim 2, wherein the fuel layer includes a generator of alpha particles upon impingement by the energetic particle.

14. The energy converter of claim 2, wherein the fuel layer includes $^{241}$Americium.

15. The energy converter of claim 1, further comprising spacers separating successive conductors.

16. The energy converter of claim 15, wherein the spacers are insulators.

17. The energy converter of claim 15, wherein the spacers are semiconductors.

18. An energy converter for converting kinetic energy of an energetic particle into electrical energy, the energy converter comprising:

a. an anode characterized by a surface;

b. a first stack comprising a plurality of conductors separated by gaps of between approximately 0.1 nm and approximately 1000 nm, the conductors disposed substantially parallel to the surface of the anode to at least one side thereof, the conductors mutually electrically uncoupled;

c. a first cathode disposed at an end of the first stack of conductors distal to the anode; and d. a power management system for collecting charge deposited at the cathode in the form of current in an external electrical circuit.

* * * * *